US010989473B2

(12) United States Patent
Janssen et al.

(10) Patent No.: US 10,989,473 B2
(45) Date of Patent: Apr. 27, 2021

(54) METALLURGICAL VESSEL LINING WITH ENCLOSED METAL LAYER

(71) Applicant: VESUVIUS USA CORPORATION, Champaign, IL (US)

(72) Inventors: Dominique Janssen, Fairport, NY (US); Jose Simoes, Aveiro (PT); Roger Maddalena, Pittsburgh, PA (US); Beda Mohanty, Perrysburg, OH (US)

(73) Assignee: Vesuvius U S A Corporation, Pittsburgh, PA (US)

( * ) Notice: Subject to any disclaimer, the term of this patent is extended or adjusted under 35 U.S.C. 154(b) by 32 days.

(21) Appl. No.: 16/325,792

(22) PCT Filed: Aug. 16, 2017

(86) PCT No.: PCT/US2017/047049
§ 371 (c)(1),
(2) Date: Feb. 15, 2019

(87) PCT Pub. No.: WO2018/038983
PCT Pub. Date: Mar. 1, 2018

(65) Prior Publication Data

US 2019/0212059 A1 Jul. 11, 2019

Related U.S. Application Data

(60) Provisional application No. 62/378,706, filed on Aug. 24, 2016.

(51) Int. Cl.
*B22D 41/02* (2006.01)
*F27D 1/16* (2006.01)
(Continued)

(52) U.S. Cl.
CPC ..... *F27D 1/0003* (2013.01); *B22C 1/00* (2013.01); *B22C 1/04* (2013.01); *B22C 3/00* (2013.01);
(Continued)

(58) Field of Classification Search
CPC ..... F27D 1/0003; F27D 1/0006; F27D 1/16; F27D 2005/0075; B22D 41/02
(Continued)

(56) References Cited

U.S. PATENT DOCUMENTS 4,149,705 A 4/1979 Caudill
4,698,255 A 10/1987 Pineau
5,139,239 A 8/1992 Eccleston
5,997,802 A * 12/1999 Holcombe, Jr. ..... B22D 41/00 266/275
(Continued)

FOREIGN PATENT DOCUMENTS

EA 201791904 A1 1/2018
JP H09109327 4/1997
(Continued)

*Primary Examiner* — Scott R Kastler
(74) *Attorney, Agent, or Firm* — Thomas Clinton

(57) ABSTRACT

A lining structure for a refractory vessel contains a first layer containing refractory material; a second layer, in communication with and parallel to the first layer, containing a metal layer or component; and a third layer, in communication with and parallel to the second layer, containing refractory material. The metal component in the second layer contains filled transverse passages, between the surface of the second layer in contact with the first layer and the surface of the second layer in contact with the third layer, producing support structures to maintain the structural integrity of the refractory vessel in use.

14 Claims, 5 Drawing Sheets

(51) Int. Cl.

| | |
|---|---|
| ***F27D 1/00*** | (2006.01) |
| ***B22C 1/04*** | (2006.01) |
| ***B22C 1/00*** | (2006.01) |
| ***C23C 12/00*** | (2006.01) |
| ***B22C 3/00*** | (2006.01) |
| *F27D 5/00* | (2006.01) |

(52) U.S. Cl.
CPC ..... *B22D 41/02* (2013.01); *C23C 12/00* (2013.01); *F27D 1/16* (2013.01); *F27D 2005/0075* (2013.01); *F27D 2005/0087* (2013.01)

(58) Field of Classification Search
USPC ..... 266/275, 280
See application file for complete search history.

(56) References Cited

U.S. PATENT DOCUMENTS

| | | | | |
|---|---|---|---|---|
| 2007/0080335 | A1 | 4/2007 | Forbes et al. | |
| 2013/0134154 | A1* | 5/2013 | Matsen | B29C 33/06 219/634 |
| 2015/0226485 | A1* | 8/2015 | Steinlage | H01F 5/02 373/8 |
| 2018/0078999 | A1 | 3/2018 | Janssen et al. | |

FOREIGN PATENT DOCUMENTS

| | | | |
|---|---|---|---|
| JP | H10296427 | A | 11/1998 |
| JP | 2001317880 | A | 11/2001 |
| WO | 2013180219 | | 12/2013 |
| WO | 2016/153693 | A1 | 9/2016 |

* cited by examiner

METALLURGICAL VESSEL LINING WITH ENCLOSED METAL LAYER

CROSS-REFERENCE TO RELATED APPLICATIONS

This application is a U.S. national stage application, filed under 35 U.S.C. § 371, of International Application No. PCT/US17/47049, which was filed on Aug. 16, 2017, and which claims priority to U.S. Provisional Application Ser. No. 62/378,706, filed on Aug. 24, 2016, the contents of which are incorporated by reference into this specification.

FIELD OF THE INVENTION

The present invention generally relates to metal forming lines such as continuous metal casting lines. In particular, it relates to a lining for a metallurgical vessel, such as a tundish, capable of reducing substantially the formation of oxide inclusions in the metal melt.

BACKGROUND OF THE INVENTION

In metal forming processes, metal melt is transferred from one metallurgical vessel to another, to a mould or to a tool. For example, a tundish of large capacity is regularly fed with metal melt by a ladle transferring metal melt from a furnace to the tundish. This allows the continuous casting of metal from the tundish to a tool or mould. Flow of metal melt out of metallurgic vessels is driven by gravity through nozzle systems located at the bottom of the vessels, usually provided with a gate system to control (open or close) the flow of metal melt through said nozzle system. In order to resist the high temperatures of metal melts, the walls of the vessels are lined with refractory material.

Metal melts, in particular steel, are highly reactive to oxidation and must therefore be shielded from any source of oxidative species. Small amounts of aluminum are often added to passivate the iron in case oxidative species enter into contact with the melt. In practice, it appears that often this is not enough to prevent the formation of oxide inclusions in the melt that produce defects in a final part produced from the melt. It has been observed that a 10 kg steel casting may contain up to one billion non-metallic inclusions, most of them being oxides. Aggregated inclusions form defects. The defects must be removed from the final part by grinding or cutting. These procedures add to the production cost and generate large amounts of scrap.

Inclusions may be the result of reactions with the metal melt; these inclusions are known as endogenous inclusions. Exogenous inclusions are those in which the materials do not result from reactions of the metal melt, such as sand, slag, and debris of nozzles; exogenous inclusions are generally thicker than endogenous inclusions.

Endogenous inclusions comprise mostly oxides of iron (FeO), aluminium ($Al_2O_3$), and of other compounds present in, or in contact with the melt, such as MnO, $Cr_2O_3$, $SiO_2$, $TiO_2$. Other inclusions may comprise sulfides and, to a minor extent, nitrides and phosphides. Since metal melts are at very high temperatures (of the order of 1600° C. for low carbon steels) it is clear that the reactivity of an iron atom with an oxide is very high and reaction cannot be prevented.

To date, most measures to reduce the presence of inclusions in a steel casting involve retaining them in the metallurgical vessel in which they were formed. The present invention proposes a different solution by reducing substantially the formation of endogenous inclusions in a metallurgical vessel with simple, reliable, and economical means.

SUMMARY OF THE INVENTION

The present invention is defined by the attached independent claims. The dependent claims define various embodiments. In particular, the present invention concerns a lining for a metallurgical vessel for casting a metal melt. Examples of such metallurgical vessels comprise a floor, surrounded by walls over the whole perimeter of said floor, and an outlet, or multiple outlets, located on said floor characterized in that at least a portion of the floor and/or of the walls comprise means for creating in casting use an oxidation buffering layer at an interphase of metal melt extending from the interface between metal melt and the walls and floor of the metallurgical vessel, such that when in casting use, the metal flow rate in said oxidation buffering layer is substantially nil, and the concentration of endogenous inclusions, in particular oxides, in said oxidation buffering layer is substantially higher than in the bulk of the metal melt.

In a particular embodiment, the structure for creating in casting use an oxidation buffering layer comprises an immobilizing layer comprising metal and lining said floor and at least some of the walls of the vessel, said immobilizing layer being enclosed by layers of refractory material. The structure is thus constructed from a first or working layer of refractory material in contact with the metal melt in the vessel; underlying the first layer is a second layer containing metal; under the second layer is a third layer comprising a refractory material. In use, the metal may remain in the solid state in the second layer, or may be partially or completely converted to the liquid state in the second layer. A perforation is a channel or passage through a layer, enabling a fluid to pass from one side of the layer to the other. In particular embodiments of the invention, metal melt contained in the vessel may penetrate into porosity or perforations contained in the first layer of this immobilizing layer to become incorporated into the second layer. As the second layer is in close contact with the refractory material lining the walls and floor of a metallurgical vessel, said refractory material being identified as a major source of reagents for the formation of endogenous inclusions, be it by diffusion of the ambient air or by reaction of some of the components thereof, the metal in the second layer may, in the solid form, act as a barrier to reagents for the formation of endogenous inclusions or may, in the liquid form, retain a concentration of endogenous inclusions much higher than the bulk of the metal melt.

The first layer may be made of materials such as magnesia, alumina, zirconia, mullite, and combinations of any of these materials.

The second layer may be made of steel, aluminum, alloys or combinations of any thereof.

BRIEF DESCRIPTION OF THE FIGURES

Various embodiments of the present invention are illustrated in the attached Figures.

DETAILED DESCRIPTION OF THE INVENTION

Figure 1:
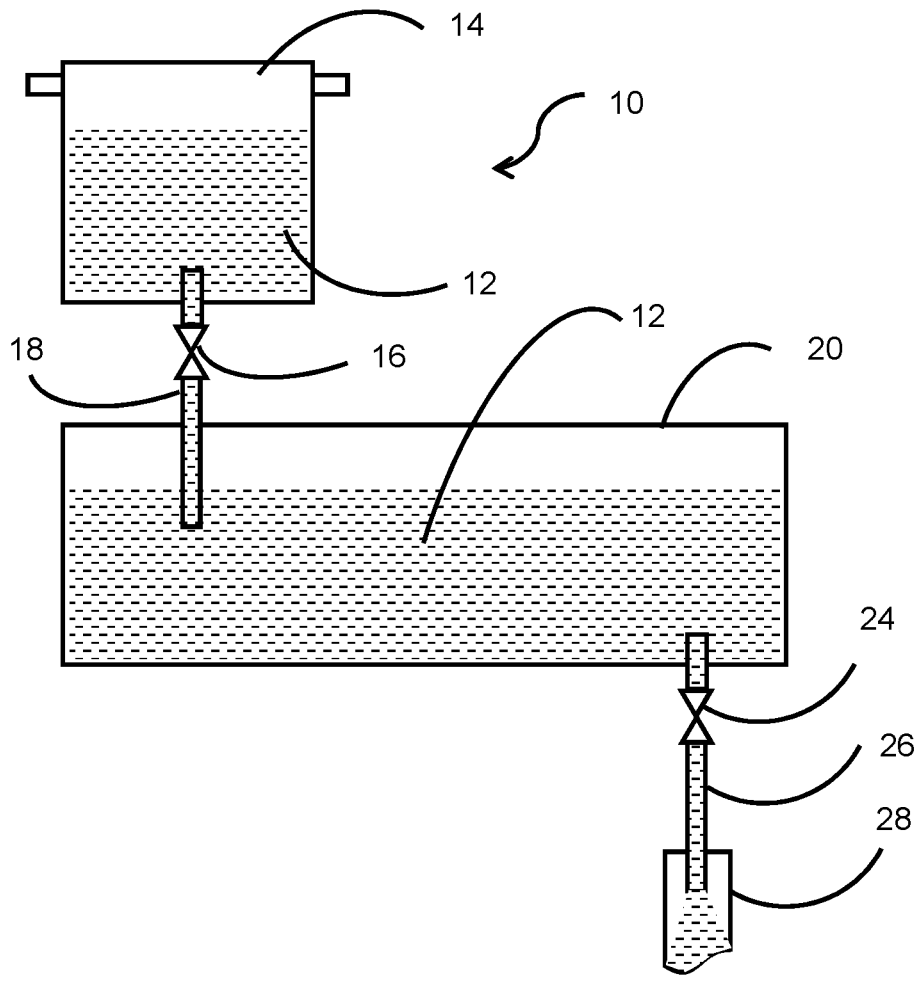
FIG. 1 shows schematically the various components of a typical continuous metal casting line.

As can be seen in the depiction of a casting apparatus 10 in FIG. 1, a tundish is generally provided with one or several outlets generally located at one or both ends of the vessel, and away from the point where metal melt 12 is fed from a ladle 14. Metal melt exits the ladle 14 through a ladle valve 16 and ladle nozzle system 18 into tundish 20, and exits tundish 20 through tundish valve 24 and tundish nozzle system 26 into mould 28. A tundish acts much like a bath tub with open tap and open outlet, creating flows of metal melt within the tundish. These flows contribute to a homogenization of the metal melt and also to the distribution within the bulk of any inclusions. Concerning endogenous inclusions, it was suspected that the reaction rate (mostly oxidation) is strongly controlled by the diffusion of reactive molecules. This assumption was confirmed by an experiment, wherein a low carbon steel melt was held in a crucible placed in a conditioning chamber free of oxygen. A pipe was introduced into said metal melt and oxygen was injected at low rate. After a time, the metal melt was left to solidify and the composition of the ingot thus obtained was analyzed. As expected, the oxidized region was limited to a small region around the outlet of the oxygen pipe, thus confirming the assumption that oxidization reaction is strongly diffusion controlled. It follows that if metal flow can be stopped, oxidation would stop too. Of course, this is not possible in a continuous casting operation which, as its name indicates, is characterized by a continuous flow of metal melt.

The second assumption which led to the present invention was that oxidation reagents originate at the walls and floor of the metallurgical vessel. In particular, it is believed that oxidation reagents come from two main sources:

(a) Reactive oxides of the refractory lining, in particular silicates such as olivine ($(Mg,Fe)_2SiO_4$); and (b) Air and moisture diffusing from ambient through the refractory lining of the metallurgical vessel and emerging at the surface of the floor and walls of said vessel (e.g., a tundish).

This second assumption was validated by lab tests.

The solution, therefore, proceeded from these two starting assumptions:

(a) Metal oxidation reaction rate is diffusion controlled, and (b) Metal oxidation reagents are fed to the melt from the walls and floor of a metallurgical vessel.

The inventors developed the following solution for preventing the formation of endogenous inclusions in the bulk of the metal melt. If it were possible to immobilize the atoms forming the metal melt close to the source of oxidative species, i.e., the walls and floor of a metallurgical vessel, a "passivating layer" or a "buffering layer" would form which would be left to oxidize but, since diffusion is very slow and absent any significant flow, the oxidation reaction would not spread to the bulk of the metal melt. This principle is illustrated schematically in FIG. 4, wherein the flow rate, Q, of metal melt is substantially zero over a distance, δ, from the wall or floor lined with a refractory material. This interphase of thickness, δ, is called herein an "oxidation buffering layer." In said layer, the concentration of oxides is substantially higher than in the bulk of the metal melt. The reason is that the source of oxidation species is the walls and floor of the metallurgical vessel. Since the flow rate in the oxidation buffering layer is nearly zero, the oxidation reaction is diffusion controlled and therefore does not spread rapidly. Above said oxidation buffering layer, however, the flow rate of the metal melt increases and oxidation reaction would spread more rapidly but, absent any oxidation reagents, only very limited oxidation reactions take place above the buffering layer.

It is clear that although oxidation reactions have been mentioned in the above explanation, the same applies mutatis mutandis to other reactions such as the formation of sulfides, nitrides, and phosphides, which reaction rates with atoms such as Fe are also diffusion controlled.

Various devices or means for forming an oxidation buffering layer can be utilized according to the present invention. In a first embodiment, the device takes the form of a lining structure in which a metal layer or metal component is sandwiched or enclosed between two layers of refractory material. The enclosed metal lining structure may be used to line part or all of the floor of a refractory vessel, and may be used to line part or all of the walls of a refractory vessel. The outer or enclosing layers of the enclosed metal lining structure are made of a substantially non oxidative material with respect to the metal melt.

The outer or enclosing layers of the enclosed metal lining structure should be made of a material not reactive with metal melts, in particular low carbon steels. Certain embodiments of the invention are characterized by the absence of silicates. The materials used for making tundish foam filters are suitable for making the outer or enclosing layers of the present invention. In particular, zirconia, alumina, magnesia, mullite and a combination of these materials may be suitable for forming the outer or enclosing layers of the present invention and are readily available on the market.

The second layer is configured to maximize the area of metal that is in a plane parallel to the walls of the vessel. If the metal of the second layer is in solid form, it physically prevents oxidation agents from passing from the third layer to the first layer and consequently into the volume of the metal melt. If the metal in the second layer is converted, partially or completely, to the molten form, metal atoms in contact with the refractory lining enter in contact with oxidation reagents, such as diffusing oxygen or components of the refractory lining, and rapidly react forming oxides, in particular FeO in low carbon steel melts. Any metal melt, however, is essentially trapped within the second layer, and cannot flow significantly into the bulk of the molten metal contained within the vessel. Since the diffusion controlled spreading of the oxidation reactions is very slow in still metal melts, the reaction will propagate extremely slowly through the thickness, δ, of the lining structure. The metal melt flowing over the lining structure is therefore not contacted by oxidation reagents until the oxidation reaction has proceeded through the thickness, δ, of the layer, which can take longer than a casting operation.

It is clear from the above explanation that refractory materials used in casting operations can be used in the first and third layers of the lining structure of the present invention. The first layer and third layer may be monolithic or composed of panels.

The metal incorporated into the second layer may be provided in any form having two orthogonal dimensions that are significantly larger than a third, or thickness, dimension, such as in the form of foil, sheets, panels, slurry or compressed powder. To ensure that the first layer remains fixed with respect to the third layer during metallurgical forming operations, the metal in the second layer may have the form of sheets or panels separated by a distance into which a refractory material can be placed. In certain embodiments of the invention, metal sheets or panels constituting the second layer may be provided with transverse holes to accommodate refractory material, such as the refractory material constituting the first layer so that, when the sheet or panel is pressed into the third layer, or when the refractory material of the first layer is applied over the sheets or panels, refractory penetrates the holes and forms standoffs that fix the position of the first layer with respect to the third layer. In certain embodiments of the invention, metal sheets or panels constituting the second layer may be provided with dimples or protrusions so that, when the sheet or panel is pressed into the third layer, or when the refractory material of the first layer is applied over the sheets or panels, receiving geometries for the dimples or protrusions are formed in the first layer or third layer to engage the second layer to the first layer or the third layer.

The spacing between the major surface of the first layer facing away from the bulk of the metal melt and the surface of the third, or backing, layer facing towards the bulk of the metal melt, or the thickness of the second layer, may be in the range from and including 0.01 mm to and including 10 mm, from and including 0.01 mm to and including 20 mm, from and including 0.01 mm to and including 50 mm, from and including 0.01 mm to and including 100 mm, from and including 0.01 mm to and including 150 mm, from and including 0.05 mm to and including 10 mm, from and including 0.05 mm to and including 20 mm, from and including 0.05 mm to and including 50 mm, from and including 0.05 mm to and including 100 mm, from and including 0.05 mm to and including 150 mm, from and including 0.1 mm to and including 10 mm, from and including 0.1 mm to and including 20 mm, from and including 0.1 mm to and including 50 mm, from and including 0.1 mm to and including 100 mm, from and including 0.1 mm to and including 150 mm, from and including 0.5 mm to and including 10 mm, from and including 0.5 mm to and including 20 mm, from and including 0.5 mm to and including 50 mm, from and including 0.5 mm to and including 100 mm, from and including 0.5 mm to and including 150 mm, from and including 1 mm to and including 20 mm, from and including 1 mm to and including 30 mm, from and including 1 mm to and including 50 mm, from and including 1mm to and including 100 mm, from and including 1 mm to and including 150 mm, from and including 2 mm to and including 30 mm, from and including 2 mm to and including 50 mm, from and including 2 mm to and including 100 mm, and from and including 2 mm to and including 150 mm.

According to the present invention, a lining structure for a refractory vessel may comprise (a) a first layer having a first layer first major surface and a first layer second major surface disposed opposite to the first layer first major surface, and (b) a second layer having a second layer first major surface and a second layer second major surface disposed opposite to the second layer first major surface, wherein the first layer second major surface is in contact with, or in communication with, the second layer first major surface; and (c) a nonperforated third layer having a third layer first major surface in communication with the second layer second major surface, wherein the second layer comprises a metal component having a major surface parallel to, or adjacent to, the second layer first major surface, or to the third layer first major surface. The first layer, second layer and third layer may all be oriented in parallel. A nonperforated layer is a layer which has not been subjected to a procedure producing a channel or passage through the layer and enabling a fluid to pass form one side of the layer to another. A major surface is a surface having an area greater than the median value for all surfaces of an object. The area of the metal component surface parallel to, or adjacent to, the third layer first major surface, or to the second layer first major surface, may have a value from and including 50% to and including 100%, from and including 50% to and including 99%, from and including 50% to and including 95%, from and including 80% to and including 95%, or from and including 80% to and including 99% of the area of the third layer first major surface, or of the area of the second layer first major surface. The first layer of the lining structure may comprise a refractory material such as magnesia, alumina, zirconia, mullite, and combinations of these materials. The third layer of the lining structure may comprise a refractory material such as magnesia, alumina, zirconia, mullite, and combinations of these materials. The metal component in the second layer may contain passages between the second layer first major surface and the second layer second major surface. The passages may be filled with refractory material to produce support structures between the first layer and the third layer. The sum of the cross-sectional areas of the passages in the metal component, or the sum of the cross-sectional areas of support structures passing through the metal component, may have a value from and including 0.1% to and including 10%, from and including 0.5% to and including 10%, or from and including 1% to and including 10%, from and including 0.1% to and including 30%, from and including 0.5% to and including 30%, and from and including 1% to and including 30% of the area of the second layer first major surface.

The second layer of the lining structure may comprise a metal component constructed from foil, sheet, panel or a volume of slurry or compressed powder having the greater two dimensions of three orthogonal dimensions oriented parallel to the second layer first major surface, wherein the summed area in a plane parallel to a major plane of the second layer, of all gaps or interruptions in the metal component in the second layer is less than the summed area in a plane parallel to a major plane of the second layer, of the metal component in the second layer. In certain embodiments of the invention, the summed area in a plane parallel to a major plane of the second layer, of all gaps or interruptions in the metal component in the second layer (defined as "a1") and the summed area in a plane parallel to a major plane of the second layer, of the metal component in the second layer (defined as "a2") may have a ratio $r=a1/a2$ such that r is equal to or less than 1.0, equal to or less than 0.5, equal to or less than 0.1, equal to or less than 0.05, equal to or less than 0.02, equal to or less than 0.01, equal to or less than 0.007, equal to or less than 0.005, or equal to or less than 0.002.

In particular embodiments of the invention, the second layer may comprise a plurality of stand-off structures protruding from the first major surface of the third layer, disposed to hold the metal component of the second layer in position. In particular embodiments of the invention, the second layer may comprise a plurality of stand-off structures protruding from the second major surface of the first layer, disposed to hold the metal component of the second layer in position. The standoff structures may be formed in any suitable geometry, such as spheres, cylinders, conic sections, or prisms of polygons. The first layer and third layer may be provided with receiving geometries so that the standoff structures are immobilized when the first layer is installed with respect to the third layer.

In particular embodiments of the invention, the second layer may comprise a sacrificial structure in contact with the metal component of the second layer. The sacrificial structure is configured so that, when it is removed by combustion, heat, chemical or physical action, the metal in the second layer will be able to expand with increasing temperature without damaging the structural integrity of the refractory layers with which it is in contact. In some embodiments of the invention, some or all of the perforations or holes in metal sheets or other metal components in the second layer may be filled with sacrificial material to accommodate volume expansion of the metal on heating. Sacrificial structures may be constructed of cellulosic, plastic, or other organic materials, graphitic materials, glasses, permeable minerals, gaseous materials or metals, and combinations thereof. The material used in the sacrificial structure may take the form of a sheet, powder, sprayed slurry or gel. The sacrificial structure is placed in contact with the metal in the second layer, as part of the process of assembling the second layer in the preparation of a lining according to the invention. One or more refractory materials are then applied to the sacrificial structure to provide, after removal of the sacrificial structure, first and second layers according to the present invention.

The sacrificial structure may have a volume in the range from and including 0.05% to and including 20%, from and including 0.05% to and including 15%, from and including 0.05% to and including 10%, 0.05% to and including 5%, from and including 0.05% to and including 2%, from and including 0.05% to and including 1%, from and including 0.05% to and including 0.5%, from and including 0.1% to and including 20%, from and including 0.1% to and including 15%, from and including 0.1% to and including 10%, from and including 0.1% to and including 5%, from and including 0.1% to and including 2%, from and including 0.1% to and including 1%, from and including 0.1% to and including 0.5%, from and including 0.2% to and including 20%, from and including 0.2% to and including 15%, from and including 0.2% to and including 10%, from and including 0.2% to and including 5%, from and including 0.2% to and including 2%, from and including 0.2% to and including 1° A, from and including 0.2% to and including 0.5%, of the volume of the metal with which it is in communication.

In particular embodiments of the invention, the first layer may have a thickness in the range in the range from and including 1 mm to and including 150 mm, in the range from and including 1 mm to and including 100 mm, in the range from and including 1 mm to and including 50 mm, in the range from and including 5 mm to and including 150 mm, in the range from and including 5 mm to and including 100 mm, in the range from and including 5 mm to and including 50 mm, in the range from and including 10 mm to and including 150 mm, in the range from and including 10 mm to and including 100 mm, or in the range from and including 10 mm to and including 50 mm.

In particular embodiments of the invention, the second layer may have a thickness in the range from and including 0.01 mm to and including 150 mm, in the range from and including 0.01 mm to and including 100 mm, in the range from and including 0.01 mm to and including 50 mm, from and including 0.05 mm to and including 150 mm, in the range from and including 0.05 mm to and including 100 mm, in the range from and including 0.05 mm to and including 50 mm, from and including 0.1 mm to and including 150 mm, in the range from and including 0.1 mm to and including 100 mm, in the range from and including 0.1 mm to and including 50 mm, in the range from and including 0.5 mm to and including 150 mm, in the range from and including 0.5 mm to and including 100 mm, in the range from and including 0.5 mm to and including 50 mm, in the range from and including 1 mm to and including 150 mm, in the range from and including 1 mm to and including 100 mm, in the range from and including 1 mm to and including 50 mm, in the range from and including 5 mm to and including 150 mm, in the range from and including 5 mm to and including 100 mm, in the range from and including 5 mm to and including 50 mm, in the range from and including 10 mm to and including 150 mm, or in the range from and including 10 mm to and including 100 mm, or the range from and including 10 mm to and including 50 mm.

The present invention also relates to the use of the lining structure as previously described in a refractory vessel, and to a metallurgical vessel having an interior and an exterior, wherein the interior of the metallurgical vessel comprises a lining structure as previously described.

The present invention also relates to a process for the minimization of oxidation of a molten metal during transfer, comprising (a) transferring molten metal to a vessel having a lining structure as previously described, and (b) transferring the molten metal out of the vessel.

Figure 2:
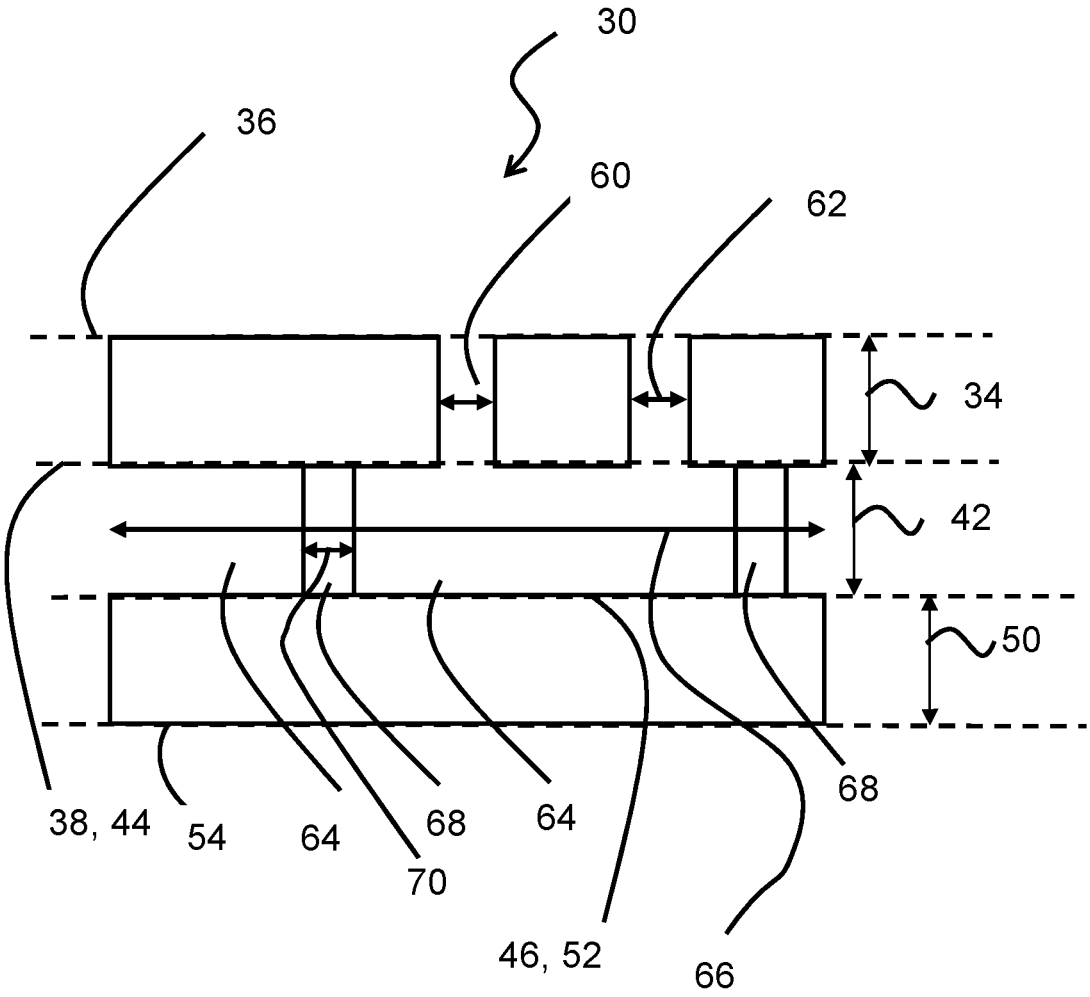
FIG. 2 shows schematically the definitions of terms used in describing the geometry of a metallurgical vessel according to the present invention.

FIG. 2 depicts a lining structure 30 according to the present invention. First layer 34 has a first layer first major surface 36 and a first layer second major surface 38 disposed opposite to the first layer first major surface 36. Second layer 42 has a second layer first major surface 44 and a second layer second major surface 46 disposed opposite to the second layer first major surface 44. The first layer second major surface 38 is in contact with, or in communication with, the second layer first major surface 44. Third layer 50 has a third layer first major surface 52 and a third layer second major surface 54 disposed opposite to the third layer first major surface 52. In certain embodiments of the invention, the first layer 34 comprises a plurality of perforations 60 passing from the first layer first major surface 36 to the first layer second major surface 38. Element 62 is the cross section of a perforation in the plane of the drawing. The second layer 42 is shown as containing metal component of the second layer 64 in communication with at least one first layer perforation 60. Metal component 64 is in communication with the second layer second major surface 46. Element 66 is a dimension of the area of metal component 64. Element 68 is a support structure enabling the positioning of metal component 64 during the construction of lining structure 30, and maintaining the spacing between first layer 34 and third layer 50. Support structure 68 may comprise refractory material from third layer 50 that is forced into second layer 42 when metal component 64 is pressed into contact with third layer 50. Support structure 68 may contain refractory material from first layer 34 resulting from the application of refractory material to second layer first major surface, and the filling of openings or passages in metal component 64 between second layer first major surface 44 and second layer second major surface 46. Support structure 68 may comprise volumes between separate pieces of metal constituting metal component 64, or may comprise openings or passages in metal component 64 extending from second layer first major surface 44 to second layer second major surface 46. Dimension of cross section of support structure 70 is a dimension that mathematically yields a cross section area of the support structure.

Figure 3:
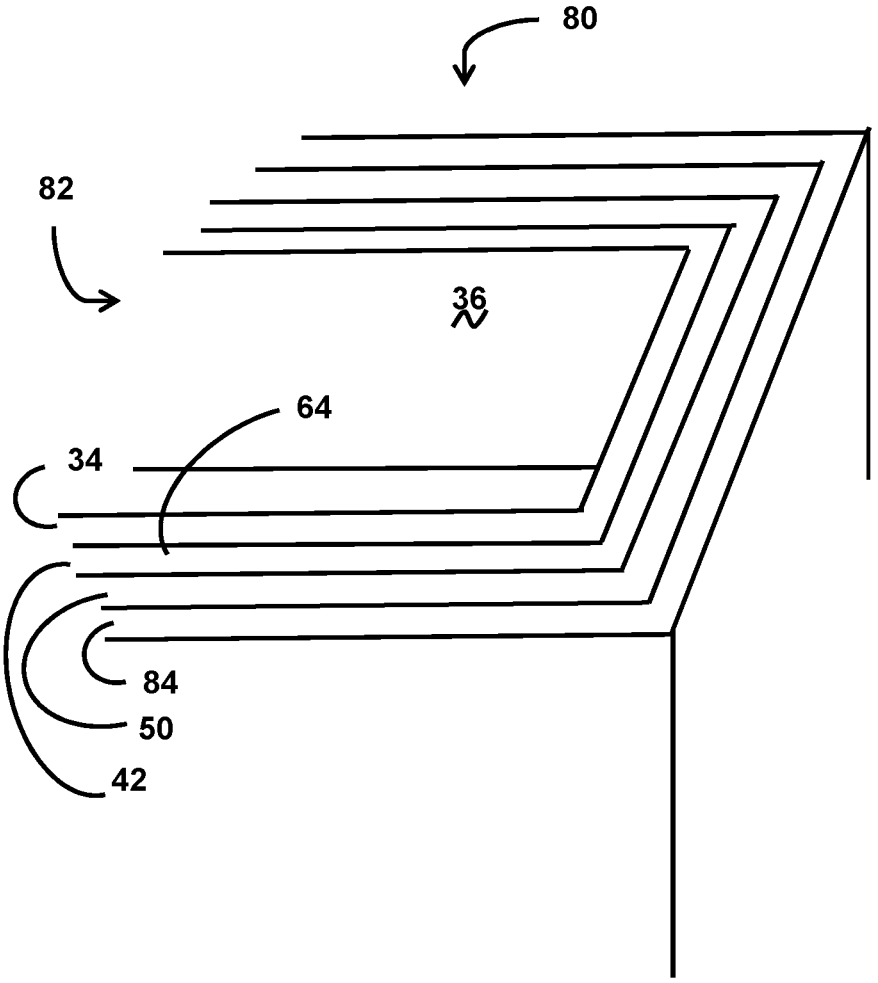
FIG. 3 is a perspective drawing of a metallurgical vessel containing a lining structure according to the present invention.

FIG. 3 depicts a metallurgical vessel 80 containing a lining structure according to the present invention, and having an interior volume 82. Element 84 is the shell, insulating layer and refractory safety layer within which the lining structure is contained. Element 84 is in communication with third layer or backing layer 50. Third layer or backing layer 50 is in communication with second layer 42. Second layer 42 is in communication with first layer 34. Second layer 42 contains metal component volumes 64. Exposed first layer first major surface 36 of first layer 34 contacts molten metal during the use of metallurgical vessel 80. In use, molten metal is introduced into interior volume 82. The metal in second layer 42 may remain entirely or partially in the solid state, or may partially or entirely undergo a phase change to the molten state. Any molten metal in second layer 42 would be constrained. It is believed that metal in either phase would contribute to the operation of the invention, as molten metal would react with species emitted by backing layer 50 to prevent them from passing into interior volume 82, and solid metal would provide a physical barrier to species emitted by backing layer 50.

Figure 4:
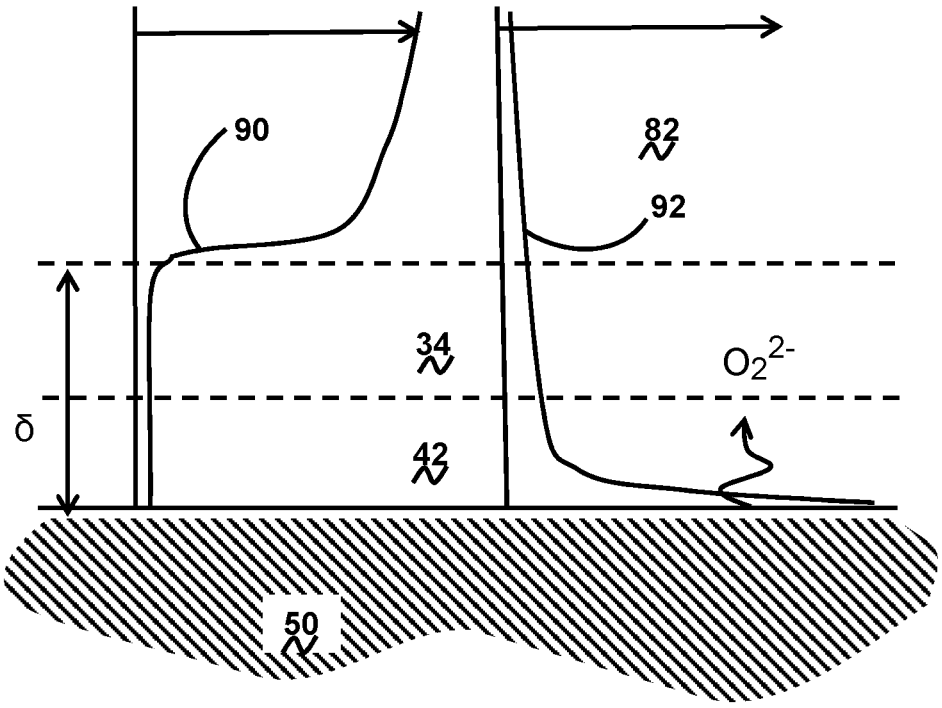
FIG. 4 shows a schematic representation of the metal flow rate, Q and iron oxide concentration as a function of distance from a wall or floor of a metallurgical vessel according to the present invention.

FIG. 4 depicts graphs of properties within a metallurgical vessel containing a lining according to the invention, assuming that metal in second layer 42 is at least partly molten. Properties are shown with respect to distance from the third layer 50 of a lining of the present invention, wherein the flow rate, Q, of metal melt is substantially zero over a distance, δ, from the third layer 50 of the lining, which may be a wall or floor lined with a refractory material. This interphase of thickness δ is called an "oxidation buffering layer." In this embodiment it corresponds to the thickness of a first layer 34 supported by a second layer 42. First layer 34 is in communication with the interior volume 82 of the metallurgical vessel. Plot line 90 indicates metal flow rate with respect to distance from third layer 50, with values increasing from left to right. Plot line 92 indicates concentration of oxides with respect to distance from third layer 50, with values increasing from left to right.

Figure 5:
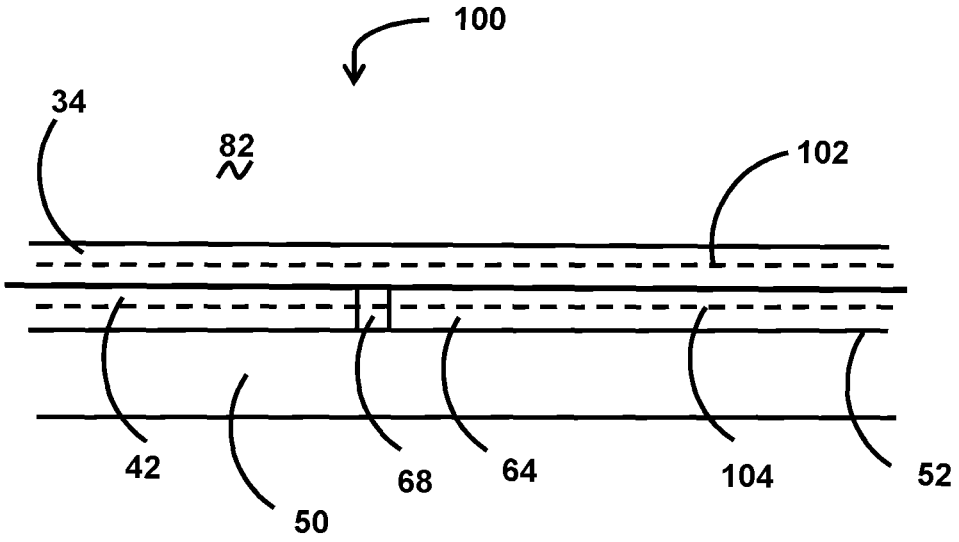
FIG. 5 shows schematically the definitions of terms used in describing the geometry of a metallurgical vessel according to the present invention.

FIG. 5 depicts a cross section 100 of a lining of the present invention. First layer 34 is supported by a second layer 42, which is in turn supported on third layer first major surface 52 of third layer 50. First layer internal major plane 102 is a plane contained within first layer 34 and parallel to third layer first major surface 52 of third layer 50. Second layer internal major plane 104 is a plane contained within second layer 42 and parallel to third layer first major surface 52 of third layer 50. Element 68 is a support structure enabling the positioning of metal component 64 during the construction of lining structure 30, and maintaining the spacing between first layer 34 and third layer 50. It may be formed from refractory material extruded through a passage in metal component 64 by pressure on metal component 64 towards third layer 50 during construction of the lining, or from refractory material extruded around the periphery of a portion of metal component 64 by pressure on metal component 64 towards third layer 50 during construction of the lining.

The configured structure of the invention may be formed by providing a base panel of a refractory material, such as an ultralow cement alumina castable, and spraying a tundish lining material, such as a magnesite spray material containing from and including 70 wt % magnesite to and including 100 wt % magnesite, on the base panel to form a third layer. A metal component sheet is then securely pressed against the magnesite spray material on the base panel to form a second layer. An alumina-based material, such as a material containing from and including 80 wt % alumina to and including 100 wt % alumina, is then sprayed on the second layer to form a first layer. Support structures for the metal component may be formed by pressing the metal component sheet against the third layer so that the material of the third layer surrounds the metal component sheet or so that the material of the third layer is forced into transverse opening in the metal sheet. In another embodiment of the invention, metal powder may be used to form the metal component or layer, and the refractory material in the first and third layers may be provided in the form of a dry-vibratable refractory lining. In yet another embodiment of the invention, a metal-containing slurry may be sprayed onto the third layer to form the metal component or layer.

The refractory materials may be applied by gunning, spray, trowelling, casting, dry-vibration application, shotcreting, grouting, pouring, injection, or placement of preformed pieces. The refractory materials may then be dried, cured or stabilized to solidify them as necessary. The resulting layered structure is then exposed to physical or chemical action to remove or transform any sacrificial structures to provide a volume to accommodate the thermal expansion of the metal component.

The second layer may have a thickness from and including 0.01 m, 0.02 mm, 0.05 mm, 0.10 mm, 0.25 mm, 0.50 mm, 1 mm, 2 mm, 3mm, 4 mm, 5 mm, 6 mm, 7 mm, 8 mm, 9 mm or 10 mm to and including 5 mm, 6 mm, 7, mm, 8 mm, 9 mm, 10 mm, 15 mm, 20 mm, 30 mm, 40 mm, 50 mm, 60 mm, 70 mm, 80 mm, 90 mm or 100 mm.

A vessel constructed according to the present invention may be used in metallurgical processes. A method of use may include introducing a molten metal into a vessel having a lining according to the present invention, and subsequently removing the molten metal from the vessel through a nozzle.

EXAMPLE I

For testing, base panels are prepared from an ultralow cement alumina castable similar to the material used as safety lining inside a steel tundish. The dimensions of each base panel are 36 inches×24 inches×5 inches (90 cm×60 cm×12.5 cm). First, a tundish lining material (Basilite, a lightweight magnesite-based spray material containing >70 wt % magnesia) is sprayed over the base panel to about 1 inch (2.5 cm) thickness, using a Basilite spray machine. Metal component sheets (20 inches×12 inches, or 50 cm×30 cm) having different opening configurations are securely pressed against the Basilite lining. Then, an alumina based material (alumina>80 wt %) is sprayed to a thickness of about 1 inch (2 cm) over the surface.

In the construction of selected panels, passages or openings will be provided in the metal component sheets. The volumes of these openings will be filled with refractory material during the construction of the panel, so that direct contact is made, through the openings, between the linings in contact with each of the surfaces of the metal component sheets.

Metal components are air dried and then fired at 1000 degrees F. for three hours to provide information on the drying behavior of the lining as well as the structural integrity.

EXAMPLE II

A MgO crucible (12 inches in height and 7.5 inches ID) is used for testing. A metal hollow cylinder with desired thickness and 5.5-6 inches OD and 10.5 inches tall is placed in the center of the crucible. The metal hollow cylinder may be provided with perforations between an interior lateral surface and an exterior lateral surface. These perforations may be filled with a sacrificial material during the construction of the crucible. The space between the inner wall of the MgO crucible and the outer wall of the metal cylinder is filled with a tundish lining material (such as Basilite). Then a cylindrical metal mandrel is placed in the centre of the crucible already containing the hollow metal cylinder. Then the space between the inner wall of the metal cylinder and the mandrel is filled with a tundish lining material (mostly high alumina). The mandrel is removed after drying the crucible at 230 degrees F. for an hour. Then the crucible is dried at 450 degrees F. for 24 hrs and then fired at 2700 degrees F. for five hours. The crucible is then examined.

Numerous modifications and variations of the present invention are possible. It is, therefore, to be understood that within the scope of the following claims, the invention may be practiced otherwise than as specifically described.

ELEMENTS OF THE INVENTION

10. Casting Apparatus
12. Metal Melt
14. Ladle
16. Ladle Valve
18. Ladle Nozzle System
20. Tundish
24. Tundish Valve
26. Tundish Nozzle System
28. Mould
30. Lining Structure
34. First Layer
36. First Layer First Major Surface
38. First Layer Second Major Surface
42. Second Layer
44. Second Layer First Major Surface
46. Second layer Second Major Surface
50. Third Layer
52. Third Layer First Major Surface
54. Third Layer Second Major Surface
60. Perforations
62. Dimension of Cross Section of Perforation
64. Metal Component
66. Dimension of the Area of the Metal Component of the Third Layer
68. Support Structure
70. Dimension of Cross Section of Support Structure
80. Metallurgical Vessel
82. Interior Volume of Metallurgical Vessel
84. Shell of Metallurgical Vessel
90. Metal flow rate with respect to distance from third layer
100. Cross section of a lining of the present invention
102. First layer internal major plane
104. Second layer internal major plane.

We claim:

1. A lining structure for a refractory vessel, comprising a) a nonperforated first layer comprising a refractory material and having a first layer first major surface and a first layer second major surface disposed opposite to the first layer first major surface, and b) a second layer having a second layer first major surface and a second layer second major surface disposed opposite to the second layer first major surface;

wherein the first layer second major surface is in communication with the second layer first major surface; and c) a nonperforated third layer comprising a refractory material and having a third layer first major surface in communication with the second layer second major surface, wherein the second layer comprises a metal component having a major surface in communication with the first layer second major surface and a major surface in communication with the third layer first major surface, and comprises refractory support structures passing through the metal component from the first layer to the third layer, wherein the metal component in the second layer contains passages extending between the second layer first major surface to the second layer second major surface accommodating the support structures, wherein the sum of the cross-sectional areas of support structures passing through the metal component has a value from and including 0.1% to and including 10% of the area of the second layer first major surface, and wherein the metal component of the second layer comprises a material selected from the group consisting of steel, aluminum, alloys and combinations of any thereof;

wherein the material is provided in the form of foil, sheets, panels, slurry, or compressed powder; and wherein the first layer is a working layer.

2. The lining structure of claim 1, wherein the area of metal component adjacent to the third layer first major surface has a value from and including 50% to and including 99% of the area of the third layer first major surface.

3. The lining structure of claim 2, wherein the area of metal component adjacent to the third layer first major surface has a value from and including 50% to and including 95% of the area of the third layer first major surface.

4. The lining structure of claim 1, wherein the area of metal component adjacent to the third layer first major surface has a value from and including 80% to and including 99% of the area of the third layer first major surface.

5. The lining structure of claim 1, wherein the first layer of the lining structure comprises a material selected from the group consisting of magnesia, alumina, zirconia, mullite, and combinations of any of these materials.

6. The lining structure of claim 5, wherein the first layer of the lining structure comprises alumina.

7. The lining structure of claim 1, wherein the third layer of the lining structure comprises a material selected from the group consisting of magnesia, alumina, zirconia, mullite, and combinations of any of these materials.

8. The lining structure of claim 7, wherein the third layer of the lining structure comprises magnesia.

9. The lining structure of claim 1, wherein the sum of the cross-sectional areas of the passages in the metal component has a value from and including 1% to and including 30% of the area of the second layer first major surface.

10. The lining structure of claim 1, wherein the first layer has a thickness in the range from and including 1 mm to and including 50 mm.

11. The lining structure of claim 1, wherein the second layer has a thickness in the range from and including 0.01 mm to and including 50 mm.

12. A metallurgical vessel having an interior and an exterior, wherein the interior of the metallurgical vessel comprises a lining structure according to claim 1.

13. Process for the minimization of oxidation of a molten metal, comprising a) transferring molten metal to a vessel having a lining structure according to claim 1, and b) transferring the molten metal out of the vessel.

14. The lining structure of claim 1, wherein the first layer and the third layer are monolithic.

* * * * *